United States Patent [19]

Alvarsson

[11] Patent Number: 4,935,186

[45] Date of Patent: Jun. 19, 1990

[54] METHOD OF MANUFACTURING CONCRETE BEAMS

[75] Inventor: Yngve Alvarsson, Huddinge, Sweden

[73] Assignee: Tremix AB, Skarholmen, Sweden

[21] Appl. No.: 292,289

[22] Filed: Aug. 2, 1988

Related U.S. Application Data

[60] Continuation of Ser. No. 832,201, Apr. 1, 1986, abandoned, which is a division of Ser. No. 588,867, Jan. 30, 1984, Pat. No. 4,598,517.

[30] Foreign Application Priority Data

Jun. 15, 1982 [SE] Sweden ..... 8203724

[51] Int. Cl.[5] ..... B28B 7/10; B28B 7/24; B28B 7/28

[52] U.S. Cl. ..... 264/297.9; 249/125; 249/131; 249/176; 264/334

[58] Field of Search ..... 264/333, 334, 297.9, 264/219, 297.8; 249/50, 122, 125, 129, 131, 176

[56] References Cited

U.S. PATENT DOCUMENTS

| | | | |
|---|---|---|---|
| 1,235,858 | 8/1917 | Tanner | 249/125 |
| 1,436,033 | 11/1922 | Hahn | 249/129 |
| 1,437,054 | 11/1922 | Hatch | 264/297.9 |
| 1,764,134 | 6/1930 | Young | 52/100 |
| 2,270,541 | 1/1942 | Martin | 264/333 |
| 2,883,728 | 4/1959 | Sederlund | 249/50 |
| 3,977,646 | 8/1976 | Moon et al. | 249/50 |

FOREIGN PATENT DOCUMENTS

| | | | |
|---|---|---|---|
| 0146678 | 1/1962 | U.S.S.R. | 264/297.9 |

*Primary Examiner*—Jan H. Silbaugh
*Assistant Examiner*—Karen D. Kutach
*Attorney, Agent, or Firm*—Sughrue, Mion, Zinn, Macpeak & Seas

[57] ABSTRACT

A method of simultaneously manufacturing a plurality of concrete beams having upper and lower flange parts which are separated by a web part and which extend over a whole length of the beams. The method includes the steps of providing a first form part constituting a bottom part including a plurality of elongate mutually spaced recesses where the recesses have a shape corresponding to the outer portion of the upper flange part of the beams and providing a plurality of elongate intermediate members having a plurality of projections extending from opposing sides thereof which are placed on the bottom part between the recesses such that the lines of contact between the intermediate members and the bottom part are displaced from the bottoms of the recesses. In this manner, when the concrete is poured into the chamber formed by the intermediate members and the bottom part, flash is not formed on the outer portion of the upper flange part of the beams formed by the first form part. Thus, the outer portion of the upper flange part of the concrete beam is smooth.

1 Claim, 2 Drawing Sheets

METHOD OF MANUFACTURING CONCRETE BEAMS

This is a continuation of application Ser. No. 06/832,201, filed Apr. 1, 1986, now abandoned, which is a division of application Ser. No. 06/588,867 filed Jan. 30, 1984, now U.S. Pat. No. 4,598,517.

TECHNICAL FIELD

The present invention relates to an arrangement for use when casting concrete floors, particularly in locales incorporating pillars, floor drains or the like. The invention also relates to a method for manufacturing concrete beams forming part of the arrangement.

BACKGROUND ART

In order to rationalize to some extent the casting of concrete floors, it has been proposed to use concrete beams as combined stop-ends and screed guides for concrete smoothing devices, the beams being embedded in the floor with the upwardly facing surfaces of the beams flush with the resultant floor surface. This eliminates the task of stripping the formwork, and hence the various spans can be cast in sequence, since adjacent spans can be cast simultaneously.

Among other things, however, these known methods do not solve the problem of providing non-contacting or isolated areas around pillars, floor-drains and the like, in a ready and simple fashion. Pillars which are not sufficiently isolated from the floor as the floor is cast, will ultimately be in load-transferring contact therewith, inter alia as a result of shrinkage stresses occurring in the concrete. This means, among other things, that when a pillar is subjected to heavy loads, which tends to cause the pillar to settle, the floor will also be subjected to stress, causing cracks to form. In addition, the pillar itself obtains therearound an area of concentrated stresses, which can readily cause the pillar to crack.

These methods used today for isolating pillars from the surrounding floor either do not provide a satisfactory result or require a large amount of additional work. Moreover, they require the floor to be cast in a plurality of stages.

The known concrete beams used as combined stop-ends and screed guides for co-action with concrete-smoothing devices are also encumbered with certain additional disadvantages. For example, they do not prevent relative movement between adjacent floor sections in the longitudinal direction of the beams. Furthermore, the webs of the beams are provided with open holes, through which reinforcing rods or the like can be passed. In order to enable the reinforcement to be compactly formed in a selective fashion, the webs of respective beams must be provided with a large number of holes, of which only a relatively small number are used in each individual case. This results in copious leakage of concrete through the beams, which is highly unsatisfactory when the beam is also to serve as a stop-end.

OBJECT OF THE PRESENT INVENTION

An object of the present invention is to provide a solution to the aforementioned problems, which manifest themselves when casting concrete floors which include pillars, floor drains and the like.

DISCLOSURE OF THE INVENTION

Accordingly, the present invention comprises an arrangement of the aforesaid kind which is characterized in that said arrangement includes straight concrete-beams which are intended to be incorporated in the cast floor, and sections of arcuate concrete-beams, said arcuate sections being arranged to co-act so as to fully encircle a free-standing pillar or the like, or to partially encircle a pillar located adjacent a floor-defining wall; in that the arcuate sections are provided with a lower support flange for supporting the ends of respective straight beams; and in that the height of the straight beams is so selected in relation to the height of the arcuate sections that when the straight beams rest on said support flanges, the upper surfaces of said straight and said arcuate beams lie in a common plane, flush with the upper surface of the resultant floor, in order to serve as guide surfaces for concrete-smoothing devices.

An arrangement of this kind enables the concrete formwork to be laid for a complete floor simultaneously, and, if time permits, for a complete floor to be cast continuously, in a single working operation, it being possible to advance the concrete-smoothing devices along the straight beams, and to pass said devices readily around the pillars present, since the arcuate sections are also able to serve as guide means. Thus, concrete can be cast around the pillars at the same time as concrete is cast in adjacent floor sections.

In accordance with one embodiment of the invention, the straight beams, each of which includes upper and lower flanges which extend along the whole length of the beam and are mutually separated by a web, preferably has a web portion which is provided on both sides of the beam with a plurality of recesses defined by said flanges and reinforcing beads connecting said flanges, said recesses being intended for anchoring the beam in the concrete floor, thereby to prevent both longitudinal and vertical relative movements between adjacent floor sections.

The web of respective beam are suitably provided with apertures through whch reinforcing-rods, and the like can be led and which are closed with a readily breakable or removeable material. For example, the lead-through apertures can be closed or covered by means of a very thin concrete membrane formed integrally with the beam in general.

By using in this way lead-through apertures which are closed when manufacturing the beams, it is possible to provide the beam with closely packed apertures, since only those apertures required to accommodate the reinforcing rods etc. need be opened, thereby provided the requisite degree of selectivity while avoiding leakage of the concrete past the side stop-ends, for example.

Preferably, the inner surfaces of the arcuate beam sections are provided with a layer of compressible material. The end surfaces of these sections may also suitably be provided with such layers. As a result hereof, in respect of load, the concrete slab around each pillar will be totally isolated from peripherally lying floor sections, i.e. not in contact therewith.

A further requirement of a beam used in an arrangement according to the invention is that the beam has a very smooth upper-flange surface, and that the surface has sharply defined edges or corners, since this surface will form part of the final floor surface. Consequently, the present invention relates to a method of manufacturing such concrete beams, said method being characterized by using a form having a bottom part which is provided with a plurality of elongate, mutually spaced, trough-like recesses corresponding to the number of beams to be produced, the form of said recesses corresponding to the outer form of the upper flange part of said beams, and elongate intermediate members; by placing the intermediate members on said bottom part, between said recesses, such that together said intermediate members and said bottom part form an upwardly open forming chamber for each beam; by filling the chambers with concrete and allowing said concrete to harden; and by removing the intermediate members for stripping the beams.

Beams having extremely smooth and even upper surfaces with sharp edges can be produced when practicing the described method, since the form, or mould, has no dividing plane located along the upper flange surface of the beams.

Other characterizing features of the invention are disclosed in the following claims.

The invention will now be described in detail with reference to the accompanying drawings.

DESCRIPTION OF A PREFERRED EMBODIMENT OF THE INVENTION

Figure 1:
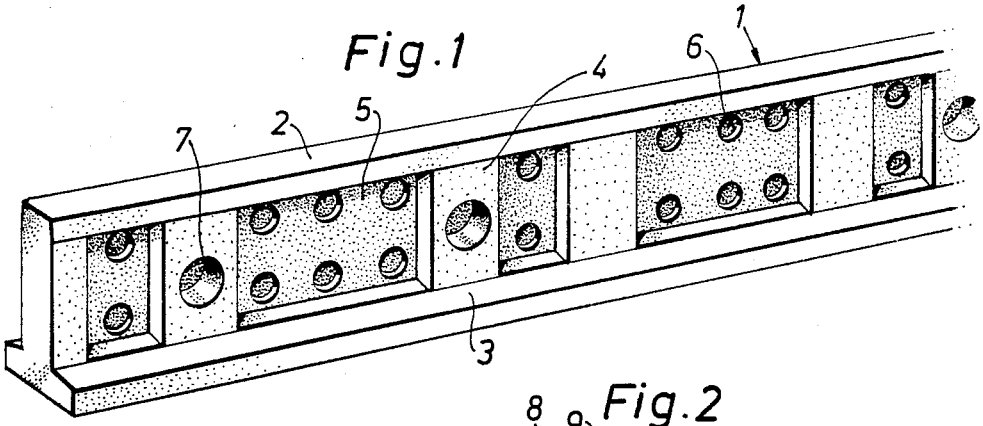
FIG. 1 illustrates a straight beam forming part of the arrangement according to the invention.

In FIG. 1 there is illustrated a straight beam 1 having upper and lower flange portions 2 and 3, which are mutually connected by a web, which comprises a plurality of stiffening beads 4 and recesses 5 arranged between said beads. The recesses 5 in the web are provided with a plurality of through-passing apertures 6, which are closed by a thin concrete membrane and which are intended to receive reinforcing rods, while larger, similarly closed apertures 7 are arranged in at least certain ones of the stiffening beads 4. The apertures 7 can be used for passing various kinds of installation pipes through the beams.

In the illustrated embodiment, both the apertures 6 and the apertures 7 are closed by thin concrete membranes, which renders the beam totally impervious and enables the beam to be used effectively as a stop-end or bulkhead. The concrete membranes covering the apertures 6 and 7, however, are so thin that they can be readily broken when passing a reinforcing rod or the like therethrough. Because the apertures are normally closed, the beam can be provided with a large number of apertures, arranged in one or more rows, enabling the reinforcing rods to be distributed as desired, and also the positioning of said rods to be varied over the whole length of the beam, without there being obtained in the process a large number of unused, open apertures. Thus, one and the same beam can be used for totally different kinds of reinforcing patterns.

The recesses 5 of the beam, which is identical on both sides, enables the beam to be firmly anchored in two mutually adjacent sections of a concrete floor, thereby preventing relative movement between said sections, both vertically and horizontally. Such movements can be caused, for example, by local heating through solar radiation or by vibrations from a machine tool.

Figure 2:
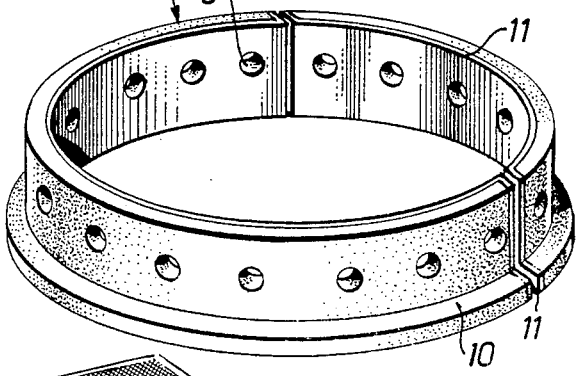
FIG. 2 illustrates two arcuate beam sections forming part of the arrangement according to the invention.

FIG. 2 illustrates a ring-shaped concrete beam 8, which is also provided with apertures 9 for passing reinforcing rods therethrough. The ring 8 is provided with a widened bottom support-flange 10, and comprises two arcuate sections, so that the ring-like beam can be placed around the pillar, floor drain or the like. As will be understood, when a pillar is located adjacent a wall or the like, one section of the ring-like beam can be used.

The inner surface of the ring beam 8 and the end surfaces of both arcuate sections are provided with a layer 11 of compressible material, such as rubber or cellular plactics, which is intended to take-up minor movement of the concrete floor and the ring beam, to prevent said beam from giving rise to stresses which can result in crack formation.

Figure 3:
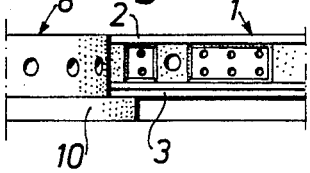
FIG. 3 illustrates the co-action between a straight beam and an arcuate beam section.

FIG. 3 illustrates the co-action between the ring-like beam 8 illustrated in FIG. 2 and a straight beam 1 illustrated in FIG. 1. As will be seen from the Figure, the heights of the beams are so in relation with one another that when the lower support flange of the straight beam is placed on the lower support flange of the ring-like beam, the upper surfaces of said beams are located in a common plane which coincides with the plane of the resultant floor. Thus, when placing the beams in position, the ring-like beams 8 are first arranged around the pillars, floor drains or the like and adjusted to the correct height. All that is then required is for the straight beam 1 to be placed on the support flanges 10 of the ring beams, said straight beams being automatically located at the correct level.

Figure 4:
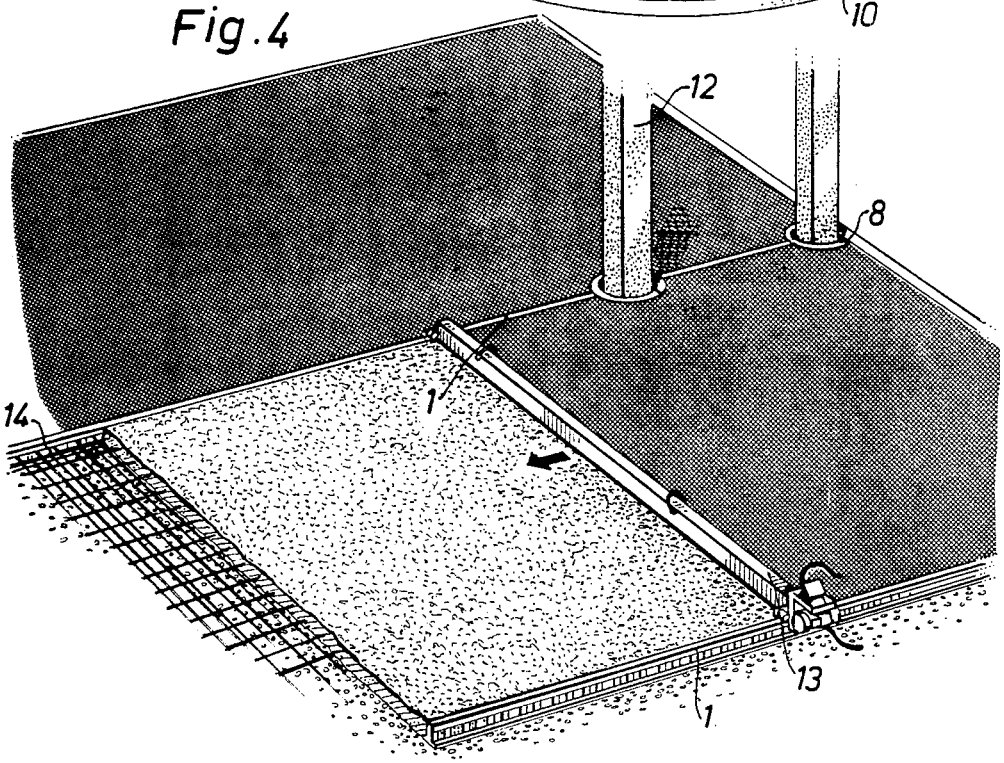
FIG. 4 illustrates how an arrangement according to the invention is applied in practice.

FIG. 4 illustrates the manner in which the beams shown in FIGS. 1 and 2 are used in practice. In this respect, the ring beams 8 are first placed around pillars 12 or the like on the foundation on which the floor is to be cast. The straight beams 1 are then laid out, so as to divide the floor into suitable sections corresponding to the length of screed bars 13. In this respect, if the ring beams 8 are located in line with the straight beams 1, the ends of the latter beams are placed on the lower support flange 10 of the ring beams, as illustrated in FIG. 3. If so is not the case, the straight beams 1 are adjusted, so that the upper surfaces of said beams are located in the same plane as the surfaces of the ring beams 8. The necessary reinforcement 14 can then be passed, with selective distribution, through the straight beams, as illustrated to the left of FIG. 4, by breaking the concrete membrane of selected apertures 6.

Reinforcing rods can also be passed into the empty space located inwardly of the ring beams 8, among other things to prevent the concrete plate surrounding the pillar from being raised relative to surrounding concrete sections. The reinforcing rods projecting into the rings 8 should be smooth, and preferably coated with asphalt or covered with plastic sleeves, so that they can be moved axially in the isolated concrete plate, since the purpose of these rods is merely to prevent vertical movement.

When all beams have been placed in position, the floor can be cast in one sequence, since the concrete of one section need not harden before an adjacent section is cast. Furthermore, the concrete sections which are isolated from the floor in general and which surround the pillars 12 can be cast at the same time as peripherally lying sections, without direct bonding between said sections being obtained therewith. A screeding bar 13 guided on the straight beams 1 can be readily caused to move around a pillar by co-action with the ring-like beams.

Thus, when using an arrangement according to the above, both the formwork and the casting of the concrete floor can be effected in a highly rational manner. In addition to the aforementioned advantages, the work previously involved in stripping the formwork is obviated, since the concrete beams used as the formwork are incorporated in the floor. The result is also better than the results obtained with known methods, since there is obtained highly effective isolation of the concrete around the pillars from the surrounding floor, which as mentioned in the aforegoing is highly significant.

In order to obtain a first class floor with beams cast therein in accordance with the aforegoing, it is necessary for the upper surfaces of the beams to be extremely smooth, and that the longitudinal edges are sharply defined and not jagged. With jagged edges, thin concrete portions are formed when casting the floor, these portions readily breaking up.

Accordingly, the present invention also relates to a method of manufacturing the aforedescribed beams, this method enabling the manufacture of beams with sharply defined, continuous edges, and smooth upper surfaces. This is achieved by placing the dividing plane for the composite form used when manufacturing the beams somewhat lower down on the beam, and not adjacent the upper surface, which is formed in an undivided form section.

Figure 5:
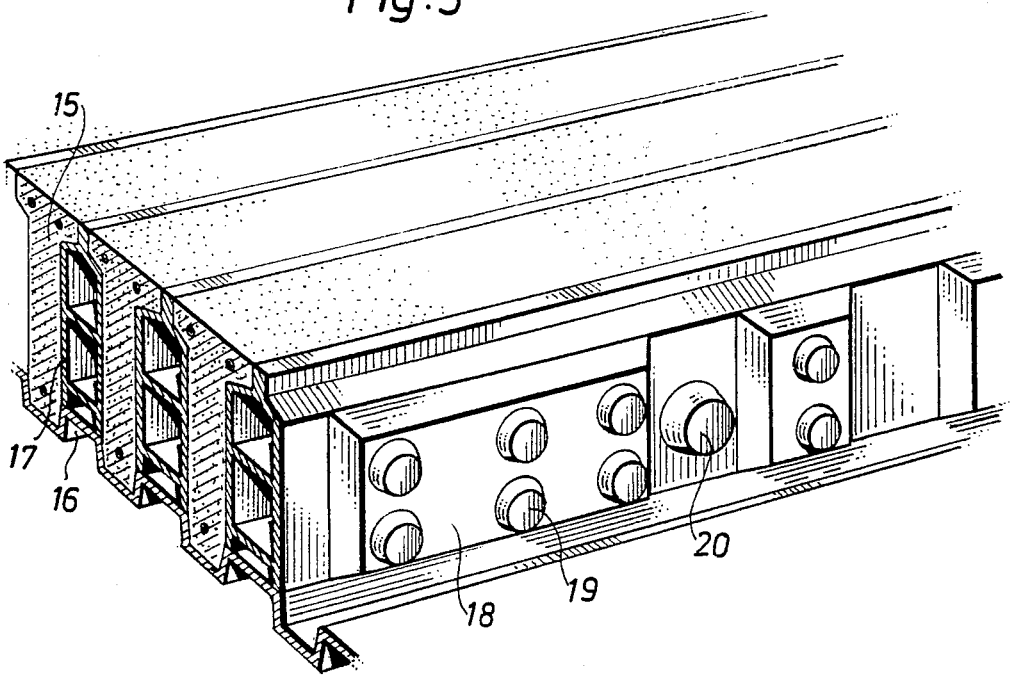
FIG. 5 illustrates schematically a forming tool for use when manufacturing straight beams in accordance with the invention.

FIG. 5 illustrates schematically a two-part form, or mould, according to the invention filled with concrete 15 and suitable reinforcement. The form comprises a lower form part, which has the shape of a corrugated plate 16, the recesses of which correspond to the upper flange part of the beam. Thus, the beams 1 are cast upside down. Intermediate members 17 are placed on the raised parts of the plate 16 which separate the trough-like recesses, the sides of said intermediate members being provided with outwardly projecting parts 18 having projections 19 intended for the lead-through apertures of the beams. For the purpose of forming apertures through the stiffening beads of the beam, projections 20 are arranged between the outwardly projecting parts 18. The projections 19 and 20 of two opposite intermediate members are located extremely close to one another when mounting the form, so that only a thin concrete membrane is obtained therebetween. As will be seen from FIG. 5, the dividing plane between the bottom form plate 16 and the intermediate member 17 is located somewhat above the longitudinal centre line of the inverse beams 1, which means that the upper surfaces and edge portions of the beams will be smooth and continuous, i.e., not jagged, as described above.

Figure 6:
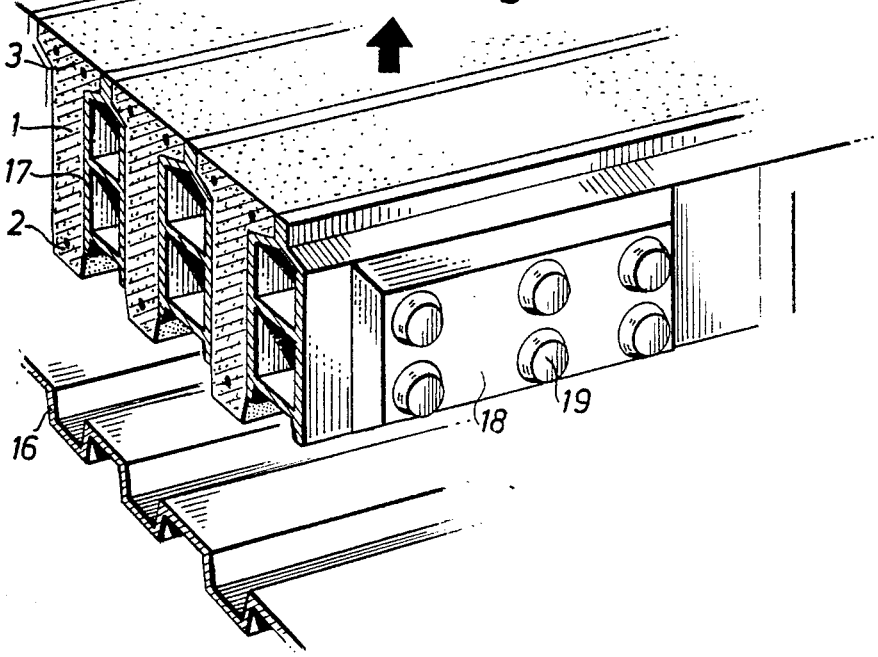
FIG. 6 illustrates the tool of FIG. 5 during a form-stripping operation.

FIG. 6 illustrates how the intermediate member 17, together with intermediate beams 1 are lifted up as a unit from the bottom form plate 16, for placing on another support prior to stripping the individual beams from the moulds or forms. When stripping the beams from said forms, it is also possible to remove the intermediate members and the beams successively from the one edge of the lower form plate 16.

The form used in the method can be designed for casting a desired number of beams simultaneously. Both the bottom form plate 16 and the intermediate member 17 are suitably made of aluminium or like material. As will be understood, a form according to the aforegoing can also be used to produce beams having open apertures, by suitable adjustment of the length of the projections 19 and 20. If so desired, the apertures in the beams can be closed by means of other readily removeable or crushable members. The design of the form sections can also be varied in other respects, in dependence upon the geometry of the beam to be manufactured.

Beams manufactured in accordance with the aforegoing are extremely rigid with the use of but a relatively small amount of material, and consequently the beams are readily easy to handle. The beams can also be manufactured at relatively low cost. As will be understood, the shape of the beams and the pattern in which the apertures are arranged can be varied as desired, which is also true of the configuration of the web portion. The ring-like beam sections need not be circular-cylindrical in shape, but may have any other suitable shape. In addition to being used for casting floor structures, the straight beams can also be used as stop-ends when casting walls or like elements, which can be incorporated in said walls or like elements.

I claim:

1. A method of simultaneously manufacturing a plurality of concrete beams having upper and lower flange parts which are separated by a web part and which extend over a whole length of said beams, said web part being provided with a plurality of recesses having thin concrete membranes disposed therein, comprising the steps of:

providing a first undivided form part constituting a bottom part including a plurality of elongate, mutually spaced, recesses, said recesses having a shape corresponding to an outer portion of said upper flange part of said beams;

providing a plurality of second form parts constituting a plurality of elongate intermediate members having a plurality of projections extending from opposing sides thereof;

placing said intermediate members on said bottom part between said recesses therein such that lines of contact between said intermediate members and said bottom part are displaced from the bottoms of said recesses and no dividing planes are located along the upper flange part forming portions of said first form part, said members together with said bottom part forming an upwardly open mold chamber in which each beam is to be formed and said plurality of projections extending from opposing sides of said elongate intermediate members confronting projections of adjacent elongate intermediate members providing a small gap therebetween;

filling said chambers with concrete such that said concrete fills said chamber including said gap to form said concrete beams with membranes in such a manner that flash is not formed on said outer portion of said upper flange part of said beams formed by said first form part;

allowing said concrete to harden; and removing said intermediate members with said beams from said bottom part and removing said beams from said intermediate members.

* * * * *